United States Patent [19]

Stewart

[11] Patent Number: 4,533,099

[45] Date of Patent: Aug. 6, 1985

[54] KITE

[76] Inventor: Keith Stewart, Melbury, Osmond, Dorchester, United Kingdom, DT20LS

[21] Appl. No.: 423,288

[22] Filed: Sep. 24, 1982

[51] Int. Cl.[3] ..... A63H 27/08; B64C 31/06; B64B 1/50

[52] U.S. Cl. ..... 244/153 R; 244/155 A; 244/33; 244/219

[58] Field of Search ..... 244/33, 153 R, 154, 244/155 A, 219 A; D21/88; 116/210; 46/89, 87, 88, 90

[56] References Cited

U.S. PATENT DOCUMENTS

| | | | |
|---|---|---|---|
| 612,996 | 10/1898 | Siegsfeld | 244/33 |
| 2,327,794 | 8/1943 | Hurt | 441/66 |
| 2,486,158 | 10/1949 | Haas | 244/33 |
| 2,769,605 | 11/1956 | Sparkman | 244/153 R |
| 2,825,803 | 3/1958 | Newbrough | 116/210 |
| 3,131,895 | 5/1964 | Moore | 244/153 R |
| 3,510,893 | 5/1970 | Moore | 441/40 |
| 3,721,983 | 3/1973 | Sherer | 116/210 |
| 3,980,260 | 9/1976 | Laske | 244/153 R |
| 4,026,504 | 5/1977 | Christoffel, Jr. | 244/155 A |
| 4,261,534 | 4/1981 | Roselli | 244/31 |

OTHER PUBLICATIONS

"Kites", David Pelham, p. 135, 1976.

*Primary Examiner*—Trygve M. Blix
*Assistant Examiner*—Rodney Corl
*Attorney, Agent, or Firm*—Fiddler & Levine

[57] ABSTRACT

A kite has an inflatable body and flexible sheet material flaps extending to a tail thereof. Along the trailing edge of each flap is provided an inflatable tube, the degree of inflation of which can be variable to change the characteristics of the kite to suit different circumstances.

23 Claims, 20 Drawing Figures

KITE

This invention relates to a kite.

In my co-pending British application No. 8006264 I have described an inflatable kite and it is an object of the present invention to provide a kite which has improved flight characteristics compared with the kite described in that application.

Accordingly the invention provides a kite having an inflatable body and flaps each of sheet material and each having a trailing edge, an inflatable tube being provided along the trailing edge of each flap.

Normally there will be two such flaps, one on each side of the kite, and I have found, surprisingly, that by controlling the inflation of the two tubes, the yaw of the kite can be varied to a remarkable degree. Remote control means, such as a separate control line or lines, a radio-control arrangement or transmission along a conducting line, can permit the yaw of the kite to be varied in flight.

Each tube can be inflatable in several different ways, for example; by a scoop for directing ram air to the tube; by an inlet at a leading edge of the kite leading ram air to ducting connecting with the tube; by differential pressure between an inner and an outer skin of the kite; by a pump operated from the movement of parts of the kite in flight; or by a simple inflation inlet when a predetermined degree of inflation is The invention also provides a kite having an inflatable body portion divided internally into two or more compartments which can be inflated individually to desired degrees to vary the aerodynamic shape of the body portion.

Surprisingly, I have found that the provision of the two or more compartments enables the aerodynamic shape of the body portion to be varied substantially to increase the lift-to-drag (L/D) ratio for various wind conditions.

Preferably, the two compartments lie one on top of the other. A first of the compartments can be defined entirely by an inner bag of flexible sheet material and a second of the compartments can be defined between an outer skin of the body portion and one face of the inner bag. Preferably the inner bag has struts, ribs or the like which constrain its shape when inflated. The inner bag can be divided into two portions front and back.

Separate inflation tubes can connect one with each compartment, or can inflate each compartment individually.

Each kite of the invention can have a bridle, between itself and the control line, consisting of several individual ligaments each connecting with the body of the kite at a separate connector. This reduces the loading on each connecting point. The bridle can include one or more elastic ligaments to absorb shock loads and to allow the kite body to change attitude when wind speed changes.

The invention will be described further, by way of example, with reference to the accompanying drawings, wherein:

A preferred kite of the invention is made, as described in my aforesaid earlier application by disposing two or more layers of weldable, flexible, gas-impermeable plastics material or of metallic foil, or combinations of metallic foil and plastic layers in face to face relationship and welding or otherwise connecting them together in an air-tight manner along lines a—b, a—d, b—fn, d—e—m. and m—c and n—c. This gives a kite body having a generally arrow-shaped inflatable portion and two flaps p, q. These two layers form upper and lower outer skins of the inflatable body portion and an inner bag is sandwiched therebetween, and attached thereto at the aforesaid weld lines, as will be later described. As is apparent where metallic foils are used the material is radar reflective.

To distribute the load imposed on the body by the lines, there is a bridle arrangement consisting of a front ligament r (attached at g), a pair of rear ligaments r1 and r2 (attached at h and i) which join and connect to a rear common ligament r3 which connects with r at its junction with the line proper, r3 includes an elastic ligament r4, in parallel with a limiting elastic ligament r5, for absorbing shock loads and allowing the kite body to change attitude when the wind speed changes.

Figure 1:
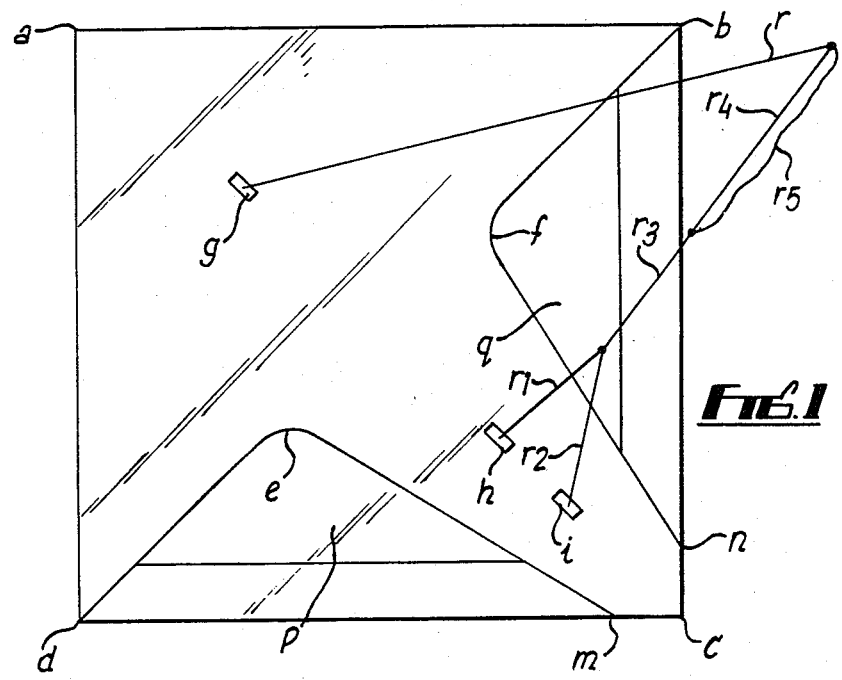
FIG. 1 is an underneath view of a kite of the invention in an uninflated condition.
Figure 2:
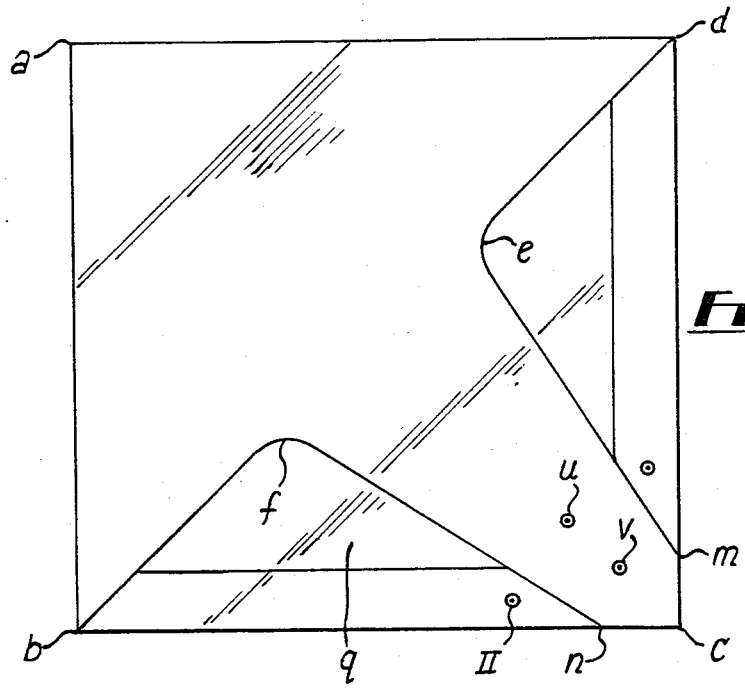
FIG. 2 is a top plan view of the kite, uninflated.
Figure 3:
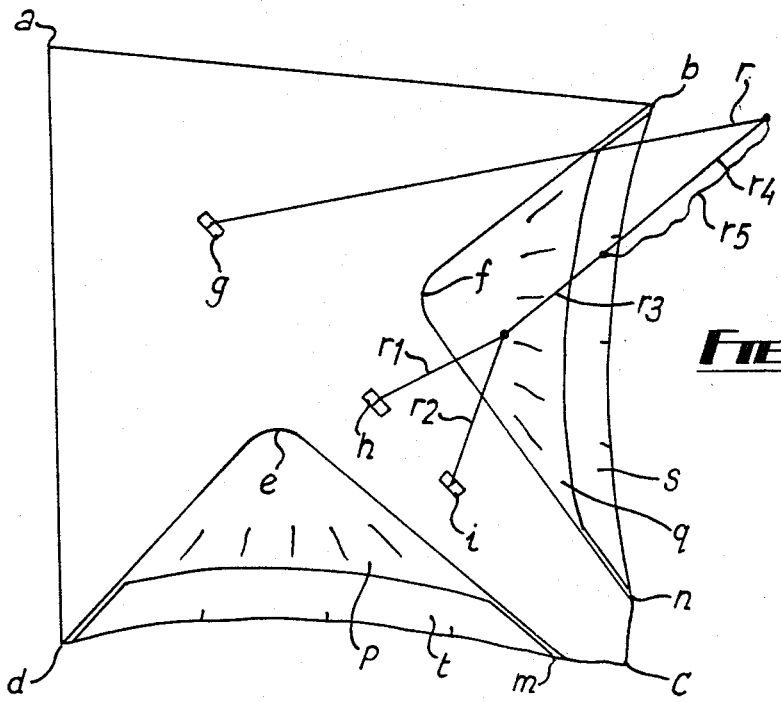
FIG. 3 is an underneath plan view of the kite inflated.
Figure 4:
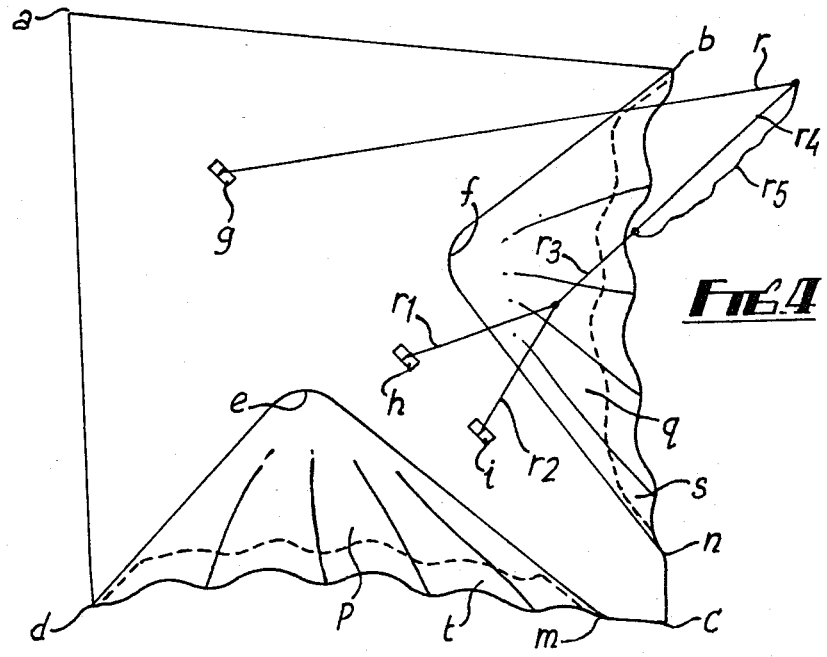
FIG. 4 is a top plan view of the kite inflated.
Figure 5:
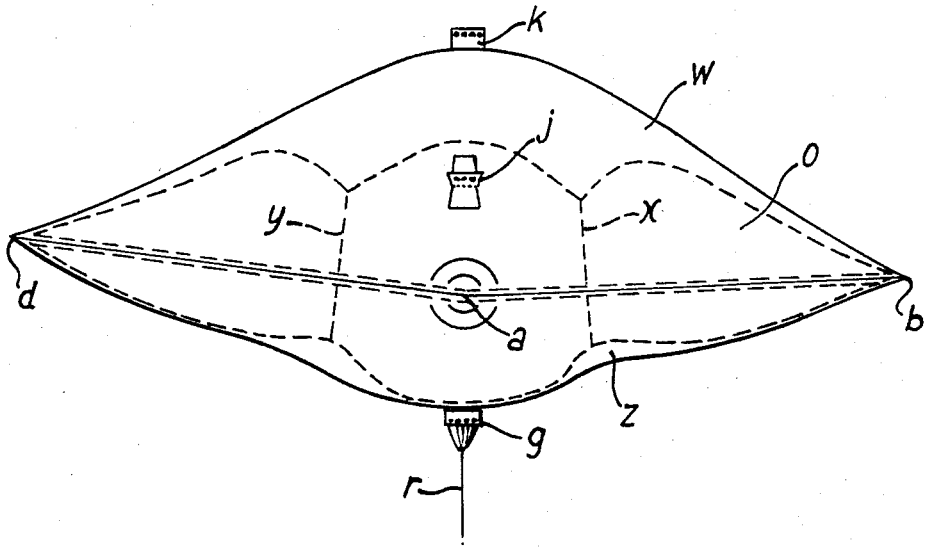
FIG. 5 is a front elevation of the kite inflated.
Figure 6:
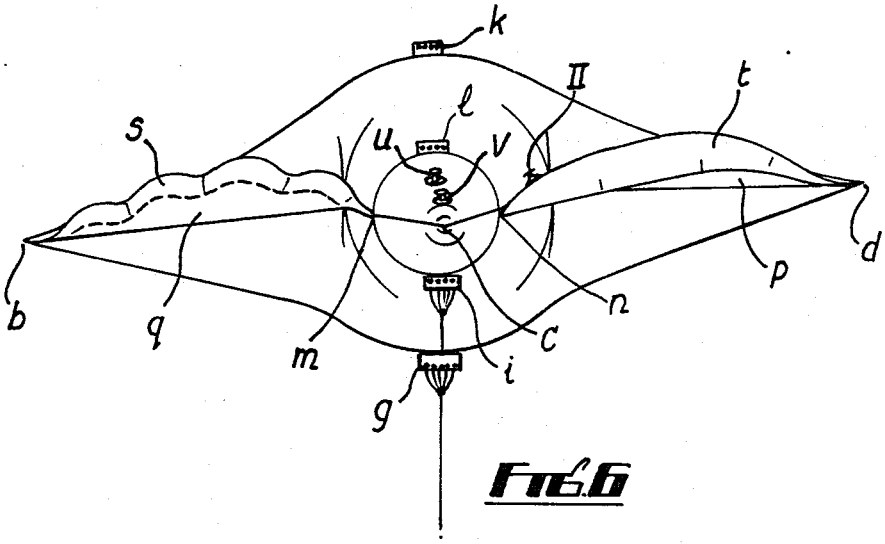
FIG. 6 is a rear elevation of the kite inflated showing one trailing edge tube inflated and the other deflated.
Figure 7:
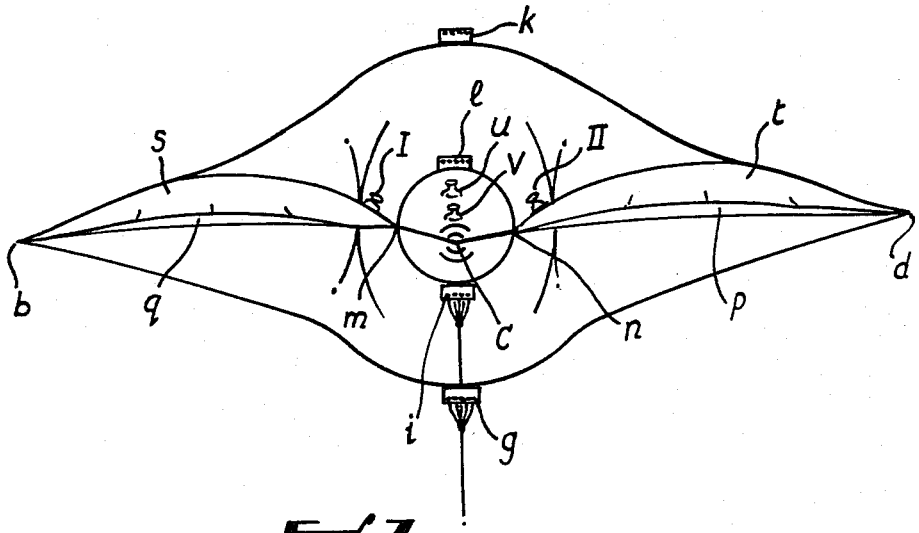
FIGS. 7 and 8 are views similar to that of FIG. 6 but showing both tubes inflated and deflated respectively.
Figure 8:
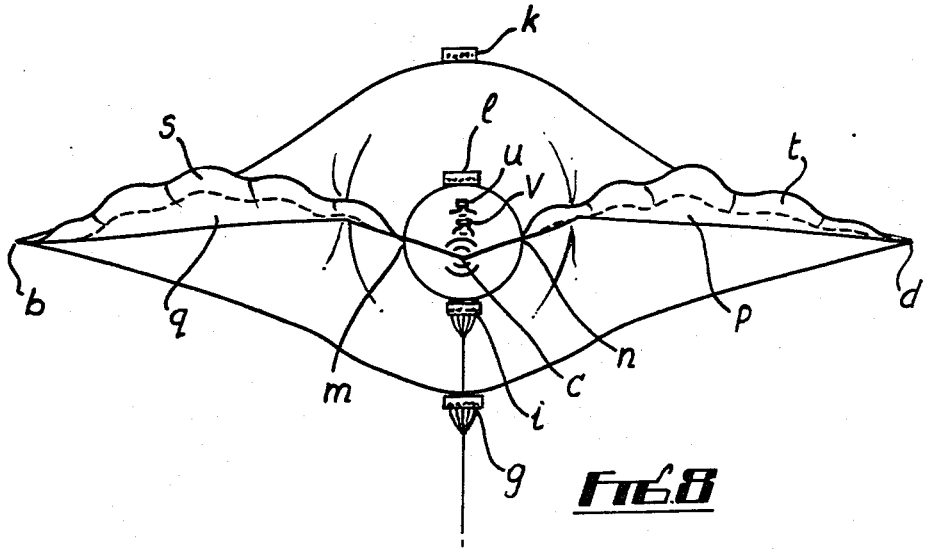

Each attachment point g, h, i, can be a piece of sheet material welded to the outer layer and individual smaller bridles can be provided, as best seen in FIGS. 5 and 6 to spread the load.

The trailing edge of each flap p, q, is provided with an inflatable tube (t, s) which can be inflated by inflation tubes I, II. By varying the extent of inflation of the two tubes (t, s), the yaw of the kite can be varied. The tubes can be inflatable selectively by remote control, such as by a separate line or lines, by radio control, or by signals passing along a conductive line. In these cases inflation of the tubes (t,s) would best be achieved by a valved ram-air inlet at the tube or at a leading edge of the kite. As a further possibility differential pressure between varied skins of the inflatable body portion could be used to inflate the tubes. A further possibility is the provision of a pump operated by movement of the various parts of the kite in flight. A still further possibility is the provision of an electrically driven pump. The pump can direct air from tube-to-tube or inflate the tubes. Power can be supplied by a battery carried by the kite with control being exercised via a conductive line, or power can also be supplied via a conductive line.

This method of yawing the kite is highly efficient and a great improvement on previous known methods.

It is possible by inflating both tubes t, s simultaneously to obtain a higher angle of elevation than when the trailing edge flaps, and by deflating one section in relation to the opposite section it will automatically yaw the kite to the side corresponding to the most inflated section. The degree of yaw will vary according to the differential in pressure between the two trailing edge tubes. The diameter of these tubes along the trailing edge is important. For instance, with a kite with a 2 meter×2 meter layflat surface, the maximum layflat diameter of this tube must not be more than 17 cms otherwise the kite will yaw in the opposite direction in an uncontrollable manner, and if both tubes are inflated instead of giving the kite a higher L/D ratio with stability the kite will have a lower L/D and be uncontrolled in movement. The whole system of yaw can either be operated by remotely controlled valves which are actuated to release or increase pressure, and in certain circumstances can if required be operated by a second or possibly two extra lines to the operator. The remote control can be by means of a radio transmitter and receiver or by direct wire transmission from base.

Figure 9:
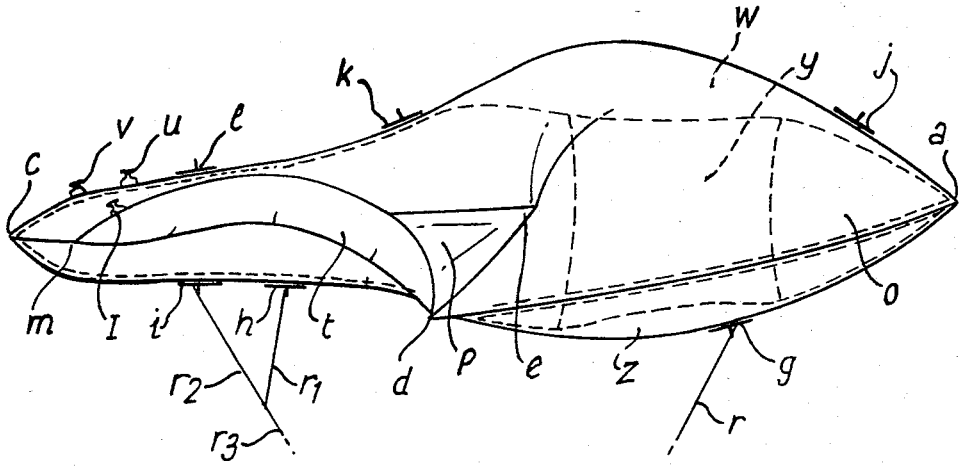
FIG. 9 is a side elevation of the inflated kite showing one tube inflated.
Figure 10:
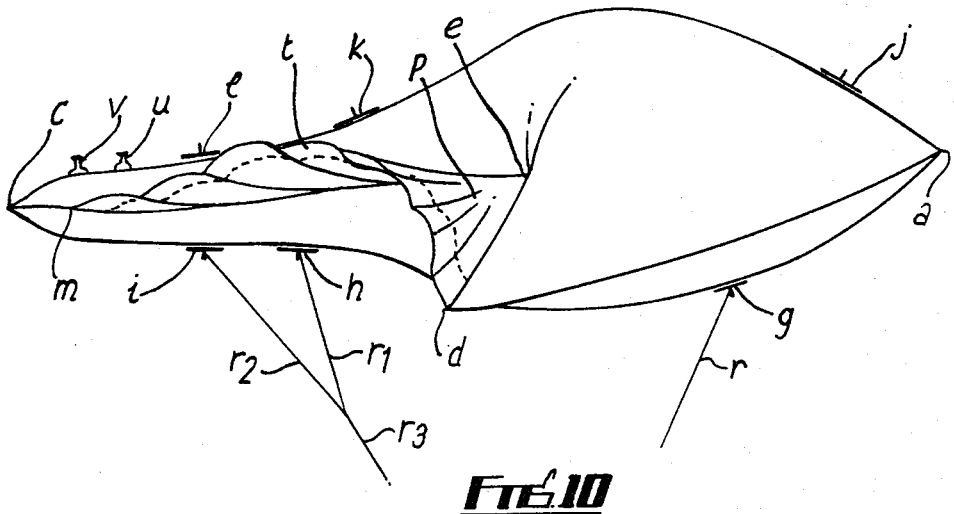
FIG. 10 is a similar view showing the tube deflated.

As best seen in FIGS. 5 and 9 the kite of the invention has its inflatable body portion divided into three compartments (w, o, z) by two inner layers or skins. The two inner layers form a separate inflatable bag whose shape in controlled, by structures such as ribs or struts x, y, to that shown in FIG. 5. The bag is separately inflatable by a tube (v) (FIG. 9). On various different shapes of a kite and particularly on larger kites more than two ribs could be used.

The space w between the bag and the upper outer layer is inflatable by a tube (u). Space z is normally uninflated, but could be via a separate tube (not shown) if desired.

By varying the degree of inflation of compartment o and w it is possible to vary the aerodynamic shape of the kite to give an optimum L/D ratio for a given wind speed. The ribs x, y prevent the inner bag taking up a shape too close to spherical, so giving the kite a flatter, more airfoil-shaped configuration.

The invention is not limited to the precise details of the foregoing and variation can be made thereto. For example, all the various modifications, fitments, attachments and forms of decoration mentioned in my aforesaid earlier patent application can be incorporated in the kite of the present invention. In particular, a selected one or selected ones of the compartments and/or the flap edge tubes can be inflated with a gas different from air, in particular helium, to vary the characteristics of the kite. It is particularly beneficial to fill the the inner bag with helium and the outer upper compartment with air.

The two or four layers of the kite need not be square, but can be of diamond shape, or any other convenient shape symmetrical about a centre line.

As a particular such alternative shape the kite can, in plan have a transversely extending section shaped like a conventional wing and a forwardly projecting generally triangular-shaped nose section, giving the kite an overall shape midway between a delta-wing shape and a conventional wing shape. The conventional wing section can have reinforcing ribs which extend transversely of the kite to give great strength and rigidity. However, such ribs would give great wind resistance and they are thus covered by a second skin forming an inflatable compartment above the wing. The lower face of the wing can be covered by an outer lower skin which remains uninflated. The nose section can itself have one or more separately inflatable compartments. In particular the nose section can have an upper and a lower compartment each separately inflatable.

Figure 11:
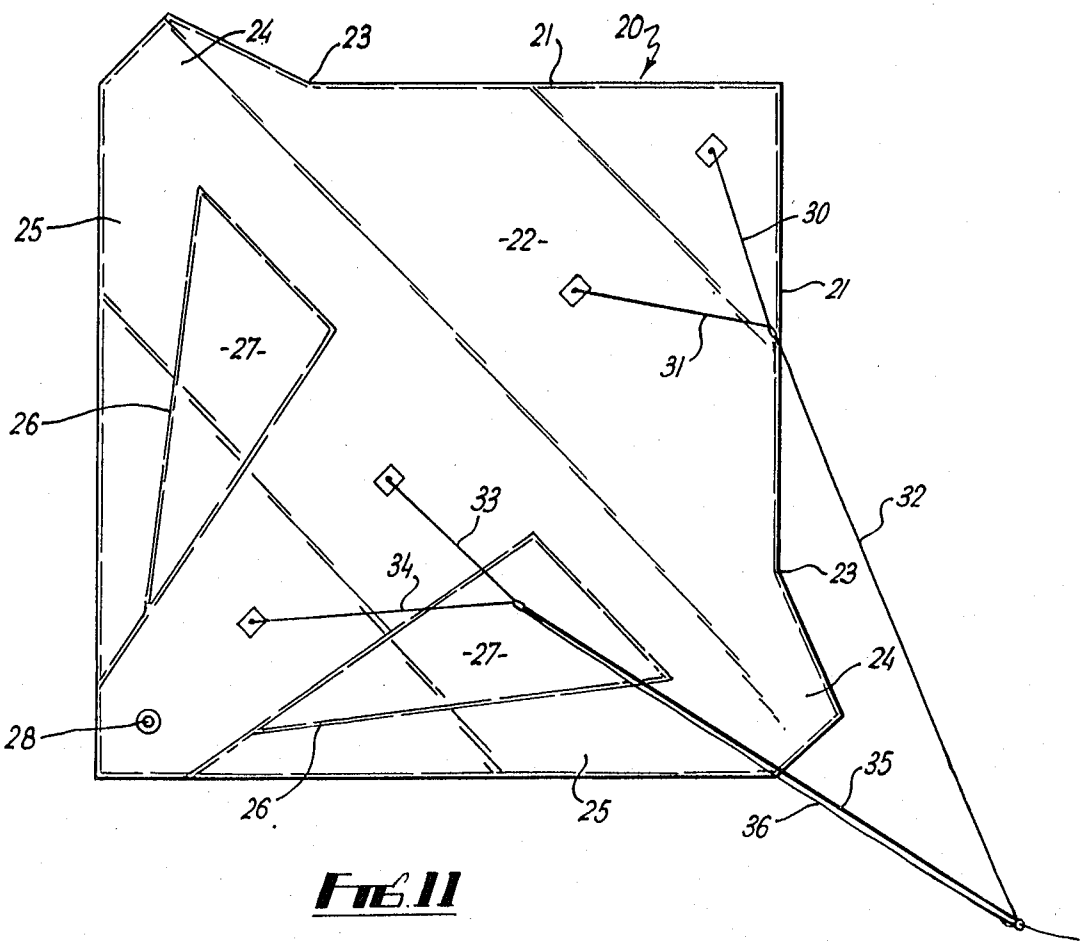
FIG. 11 is an underneath view of a further embodiment of kite.
Figure 12:
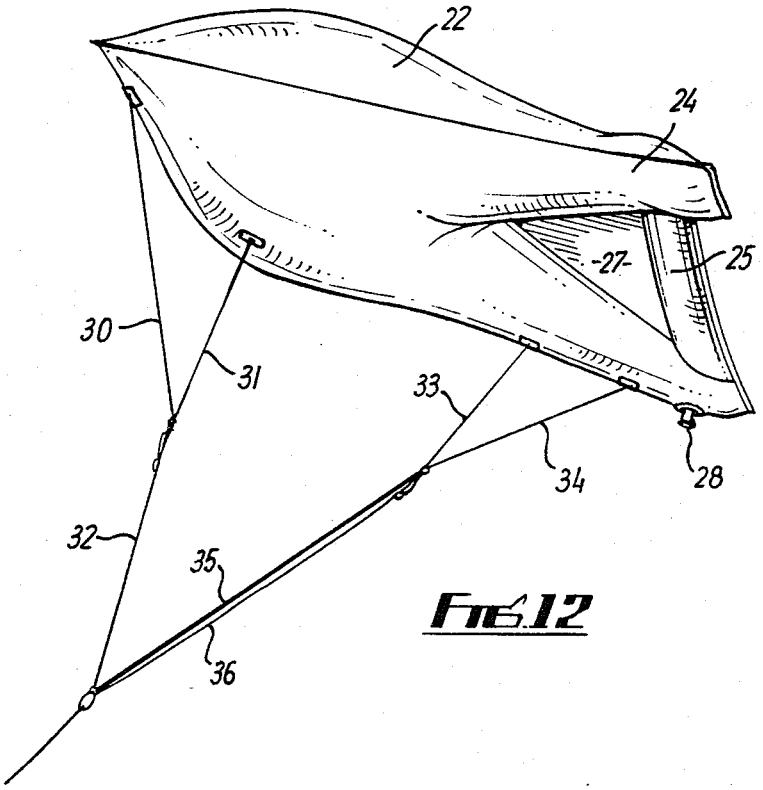
FIG. 12 shows the kite of FIG. 11 inflated.

The kite 20 of FIG. 11 is similar in general form to those described above but has the leading edges 21 of its main body 22 outwardly deflected at 23 to form small wings 24. Inflated tubes 25 extend rearwardly and inwardly along the trailing edges 26 of flaps 27 and are inflated simultaneously with body 22 by means of inflation tube 28. This kite 20 has an adjusting yoke 29 comprising inextensible front cords 30, 31 and 32, inextensible rear cords 33 and 34 and an extensible rear ligament 35 which normally functions when the kite is flying. Only when very high winds occur does the ligament 35 stretch to its maximum (the illustrated condition) where its stretch is limited by inextensible cord 36. The kite is able thus to adjust its attitude relative to winds of a range of strengths.

FIGS. 13 to 16 show the way in which the kite automatically inflates from a gas cylinder 54 on being activated from a switch 56. This switch 56 can be remotely controlled or time controlled. The actual opening of the valve on the gas cylinder 54 can be by solenoid or pyrotechnics.

Figure 15:
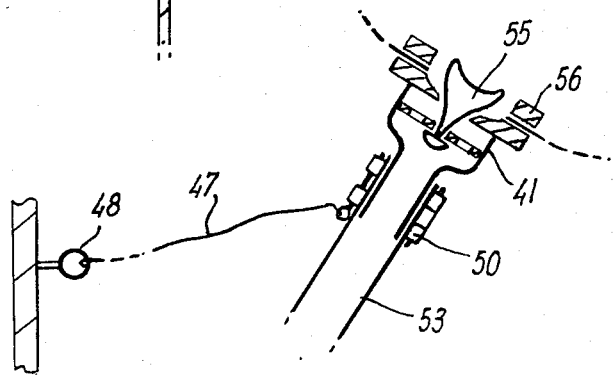

In FIG. 15 is shown the non return valve 55 in its open position with the gas entering the kite and in FIG. 11 in the closed position. Returning to FIG. 13, the kite is held to the container by a line 45 which is shorter than line 46 which in turn is shorter than inflation tube 53.

Line 45 has an O ring at the aft end connected to a pin in a release mechanism 46 so that when the kite is fully inflated the pin can be withdrawn, again by means of a solenoid or pyrotechnics, either by remote control or by a timed mechanism to release the kite.

Figure 14:
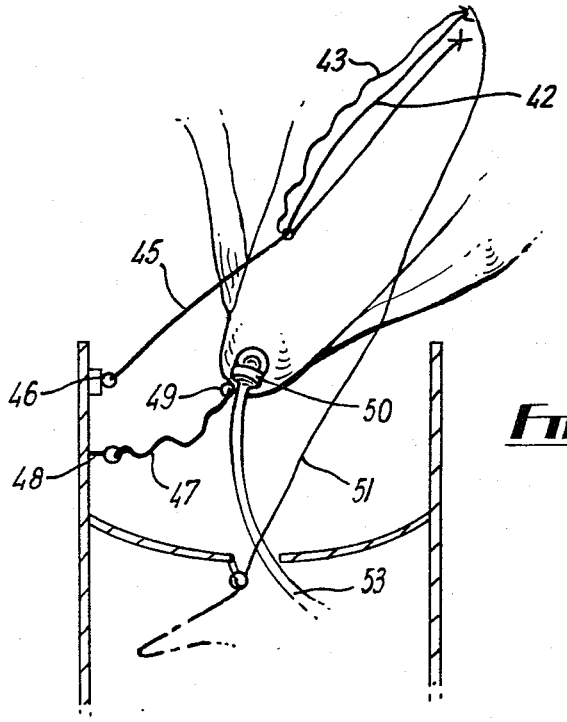

In FIG. 14 is shown the kite fully inflated with line 45 attached to the rear bridle and release mechanism 46 just before release.

Figure 16:
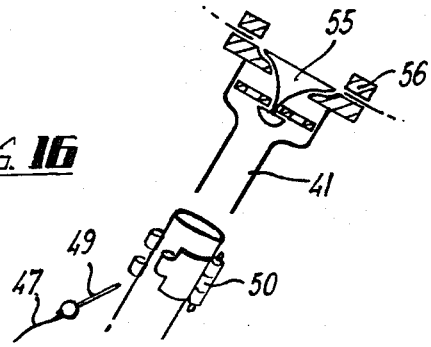

Upon releasing the kite the sequence of detaching the inflation tube is shown in FIGS. 15 and 16.

Figure 13:
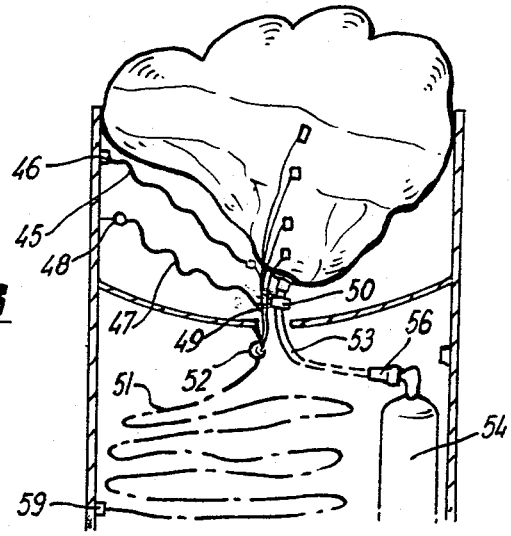
FIGS. 13 to 16 shows how a kite of the invention can be stored and automatically launched.

The line 47 is attached to the container at 48 and has a pin 49 inserted into a split circlip 50, and as the kite starts to deploy it puts pressure onto that line, 47, thereby withdrawing the pin from the circlip which then opens. After line 47 is detached, the pressure of the deploying kite transfers to the inflation tube 53 which is a loose fit (without the circlip 50) on valve 41. This immediately releases the inflation tube 53 from the valve 41 and the kite starts to deploy on the tethering line 51, which is affixed to the container at 59 (FIG. 13).

The tethering line 51 runs through a roller system 52, so that a small amount of resistance is always felt at the kite. This allows the kite to deploy in very light winds, but stops the line 51 which is flaked in the container, from having no resistance, which could force the kite to be swept along the surface of the sea (or land) by high winds. In other words the resistance is not enough to stop the kite from deploying in very light winds, but enable it to obtain aerodynamic lift in high winds.

This should stop the possibility of the kite being submerged by high seas, and not having enough static lift or buoyancy to break through the waves.

A pressure release valve 57 can be utilised should the volume of gas in the cylinder 54 be considerably more than the required volume of gas in the kite. It is mainly a safety factor to ensure that the kite is not overinflated, although for sea rescue purposes the cylinder 54 will contain the correct amount of gas for a particular kite.

FIG. 16 shows the non-return valve 55 in its closed position after inflation.

Figure 17:
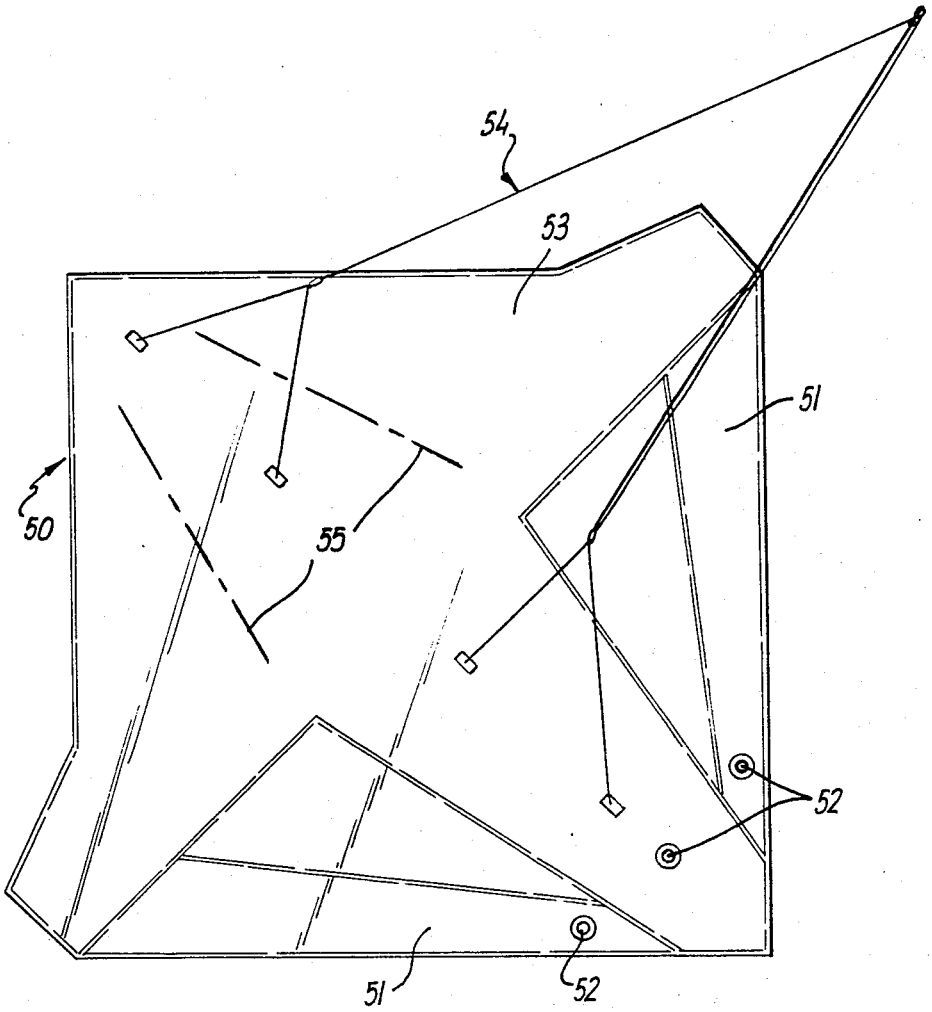
FIG. 17 shows a further different kite.
Figure 18:
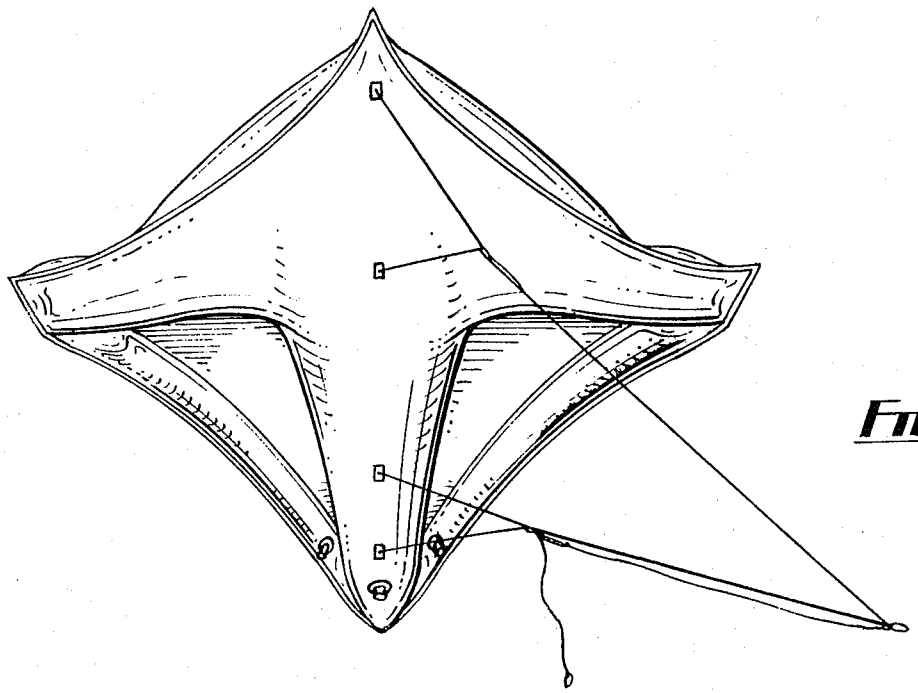
FIG. 18 shows the kite of FIG. 17, inflated.

FIG. 17 shows a kite 60 having tapered trailing edge tubes 61, three inflation points 32, one for the body 63 and one for each tube 61, a bridle 64 as previously described and internal panels 65 attached to the upper and lower surfaces of the body 63 which limit the degree of inflation of the body 63 and improve its aerodynamic shape. FIG. 18 shows the kite of FIG. 17 inflated.

Figure 19:
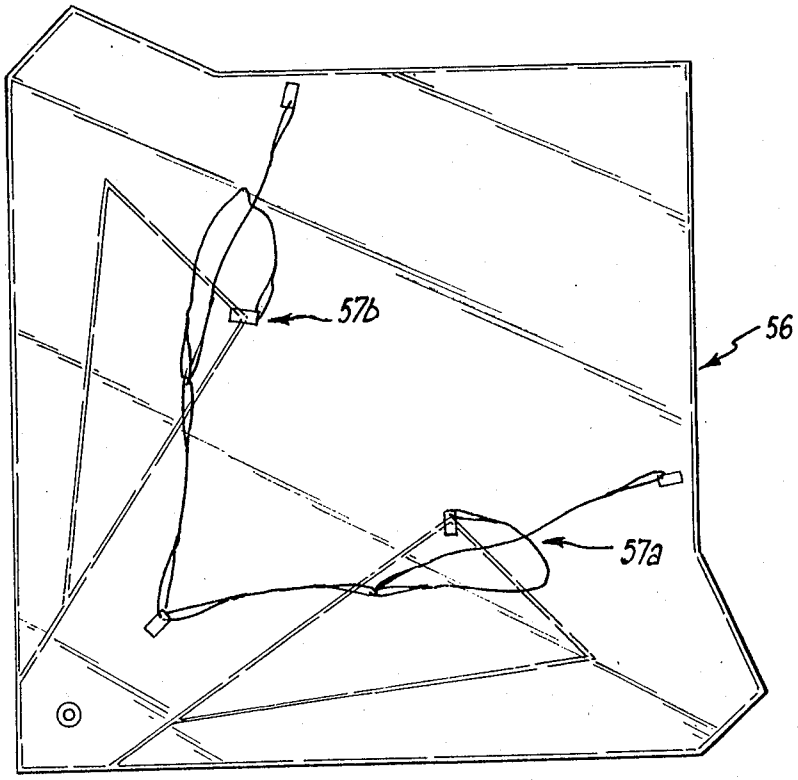
FIG. 19 shows a further still different kite.

FIG. 19 shows a kite 76 having a variation in a bridle 77 which has two portions *77a, 77b* enabling two lines to be attached for flight control.

Figure 20:
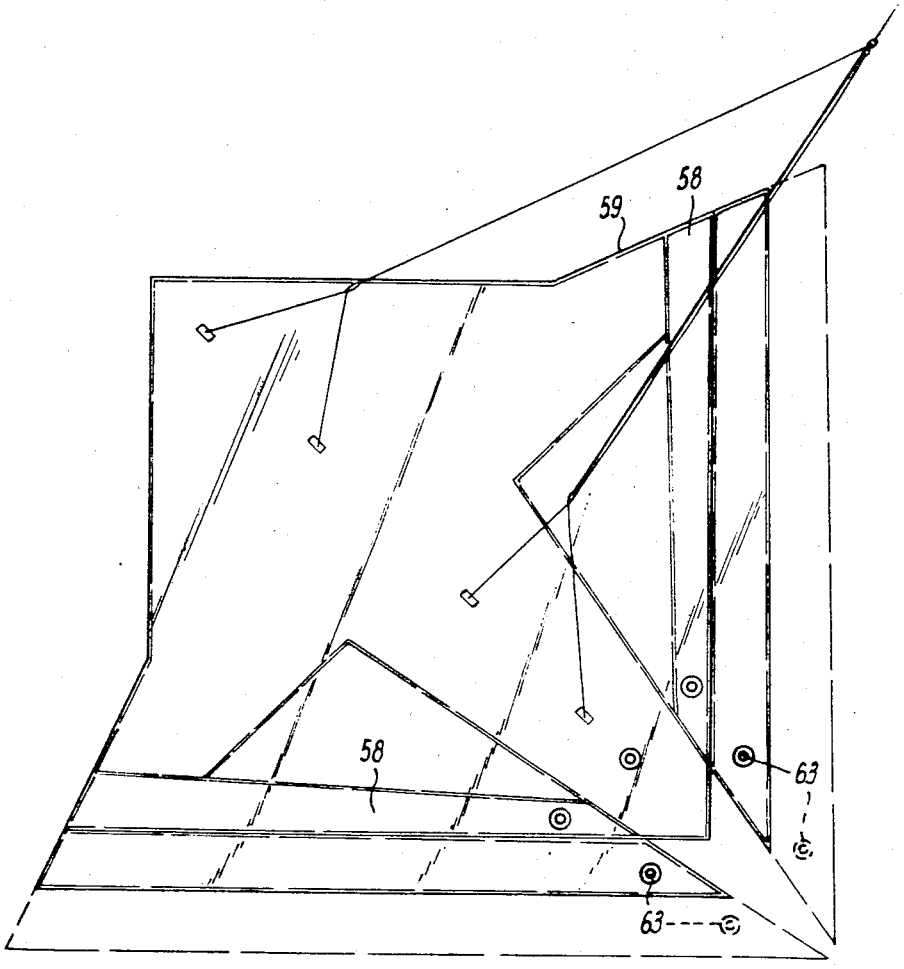
FIG. 20 shows yet another kite of the invention.

FIG. 20 shows a further variation in the shape of the trailing edge tubes 88 of a kite 89.

Each one of the kites shown can have three or more skins dividing its body into two or more separately-inflatable or non-inflatable compartments. Each kite can be inflated with a light gas such as helium or hydrogen.

The kite of FIG. 20 is particularly useful when very large structures are contemplated, for example for towing a sea-going vessel. Outwardly of tubes 88 can be provided one or more further tubes 90, 91, pairs of which can be optionally inflatable to enable the size of the kite 88 to be varied whilst it is flying. Whilst the tubes 90, 91 have been shown to be individually inflatable by means of valves 93, in practice a remote-controlled arrangement will be adopted which can be actuated from the lower end of the line whilst the kite is aloft. The number of pairs of tubes 90, 91 can be increased, but as their number does increase some stability at right angles to the length of these tubes will normally have to be provided.

I claim:

1. A kite having an inflatable body and flaps each of sheet material with each having a trailing edge, and means for varying the yaw of the kite in flight, said means being an individual independently inflatable tube provided along the trailing edge of each flap.

2. A kite as claimed in claim 1 characterised in that there are two such flaps, one on each side of the kite.

3. A kite as claimed in claim 1 characterised in that remote control means, a separate control line, and a radio controller arrangement along a conductive line are provided to permit the yaw of the kite to be varied in flight.

4. A kite as claimed in claim 1 characterised in that each tube is inflatable by a scoop for directing ram air to the tube.

5. A kite as claimed in claim 1 characterised in that it has a bridle, between itself and the control line, consisting of several individual ligaments each connecting with the body of the kite at a separate connector.

6. A kite as claimed in claim 5 characterised in that the bridle includes one or more elastic ligaments to absorb shock loads and to allow the kite body to change attitude when wind speed changes.

7. A kite as claimed in claim 1 characterised in that the kite is inflated with a lighter-than-air gas.

8. A kite as claimed in claim 7, characterised in that the gas is hydrogen or helium.

9. A kite as claimed in claim 1 characterised in that the kite is mounted in a collapsed condition in an apparatus adapted to launch it automatically.

10. A kite as claimed in claim 9 characterised in that the apparatus includes a compressed gas source and trigger means capable of: connecting the gas source to inflate the kite; and deploying it.

11. A kite as claimed in claim 1 characterised in that the tubes along the trailing edges of the flap decrease in cross-section towards a tail of the kie.

12. A kite as claimed in claim 1 characterised in that the flaps are triangular.

13. A kite as claimed in claim 1 characterised in that the kite has a harness in two parts enabling it to be controlled by a pair of lines.

14. A kite as claimed in claim 1 characterised in that the kite incorporates or consists of a radar-reflective material.

15. A kite as claimed in claim 14 characterised in that said material is a metallic foil, incorporated in one or more layers of the kite.

16. A kite as claimed in claim 1 characterised in that a harness thereof includes one or more elastic ligaments enabling the attitude of the kite to change when the wind strength changes.

17. A kite as claimed in claim 16, characterised in that the elastic ligament extends in parallel with an inextensible ligament which limits its extension.

18. A kite having an inflatable body portion divided internally into two or more compartments which can be inflated individually to desired degrees to vary the aerodynamic shape of the body portion, and means for varying the yaw of the kite in flight, said means being at least two tubes along the trailing edge of the kite which tubes are individually and independently inflatable.

19. A kite as claimed in claim 18 characterised in that the two compartments lie one on top of the other.

20. A kite as claimed in claim 19 characterised in that separate inflation tubes connect one with each compartment, or can inflate each compartment individually.

21. A kite as claimed in claim 18 characterised in that a first of the compartments is defined entirely by an inner bag of flexible sheet material and a second of the compartments is defined between an outer skin of the body portion and one face of the inner bag.

22. A kite as claimed in claim 21 characterised in that the inner bag is divided into two portions front and back.

23. A kite as claimed in claim 18 characterised in that the inner bag has struts, ribs or the like which constrain its shape when inflated.

* * * * *